US012546332B1

(12) United States Patent
Strle et al.

(10) Patent No.: US 12,546,332 B1
(45) Date of Patent: Feb. 10, 2026

(54) HIGH-EFFICIENCY COOLING FAN IMPELLER

(71) Applicant: Unada Company Limited, Nonthauri (TH)

(72) Inventors: Eduardo Strle, Mueang Nonthaburi (TH); Vinícius Burigo Neto, Florianópolis (BR)

(73) Assignee: Undada Company Limited, Bangmuang (TH)

( * ) Notice: Subject to any disclaimer, the term of this patent is extended or adjusted under 35 U.S.C. 154(b) by 0 days.

(21) Appl. No.: 18/937,077

(22) Filed: Nov. 5, 2024

(51) Int. Cl.

| | |
|---|---|
| ***F04D 29/38*** | (2006.01) |
| ***F04D 19/00*** | (2006.01) |
| ***F04D 29/32*** | (2006.01) |
| *F04D 25/08* | (2006.01) |
| *F04D 29/30* | (2006.01) |

(52) U.S. Cl.
CPC ..... *F04D 29/386* (2013.01); *F04D 19/002* (2013.01); *F04D 29/325* (2013.01); *F04D 25/08* (2013.01); *F04D 29/30* (2013.01); *F04D 29/384* (2013.01)

(58) Field of Classification Search
CPC ..... F04D 29/38–388
See application file for complete search history.

(56) References Cited

U.S. PATENT DOCUMENTS

| | | | | |
|---|---|---|---|---|
| 2,995,191 | A * | 8/1961 | Radcliffe | F04D 29/384 416/242 |
| 8,360,729 | B2 * | 1/2013 | Yagami | B21D 53/78 416/185 |
| 8,770,941 | B2 * | 7/2014 | Smith | F03D 1/0608 416/223 R |
| 10,001,135 | B2 * | 6/2018 | Pellenc | F04D 29/329 |
| 2014/0105749 | A1 * | 4/2014 | Pellenc | F04D 29/023 416/223 R |

FOREIGN PATENT DOCUMENTS

| | | | | |
|---|---|---|---|---|
| JP | 2019019758 | A * | 2/2019 | |
| JP | 2019019759 | A * | 2/2019 | |
| WO | WO-2012098277 | A2 * | 7/2012 | F01D 1/12 |

OTHER PUBLICATIONS

JP-2019019759—translation (Year: 2019).*
JP-2019019758—translation (Year: 2019).*
WO-2012098277—translation (Year: 2012).*

* cited by examiner

*Primary Examiner* — Courtney D Heinle
*Assistant Examiner* — Behnoush Haghighian
(74) *Attorney, Agent, or Firm* — D. Tiller Law PLLC; Don Tiller

(57) ABSTRACT

An impeller for use in HVAC-R fans includes a plurality of blades projecting radially from a hub. The Gaussian curvature of the pressure-side surface of the blade is substantially negative. In a preferred embodiment, the Gaussian curvature of the pressure-side surface is less than or equal to zero at all points on the surface.

9 Claims, 4 Drawing Sheets

FIG. 1A
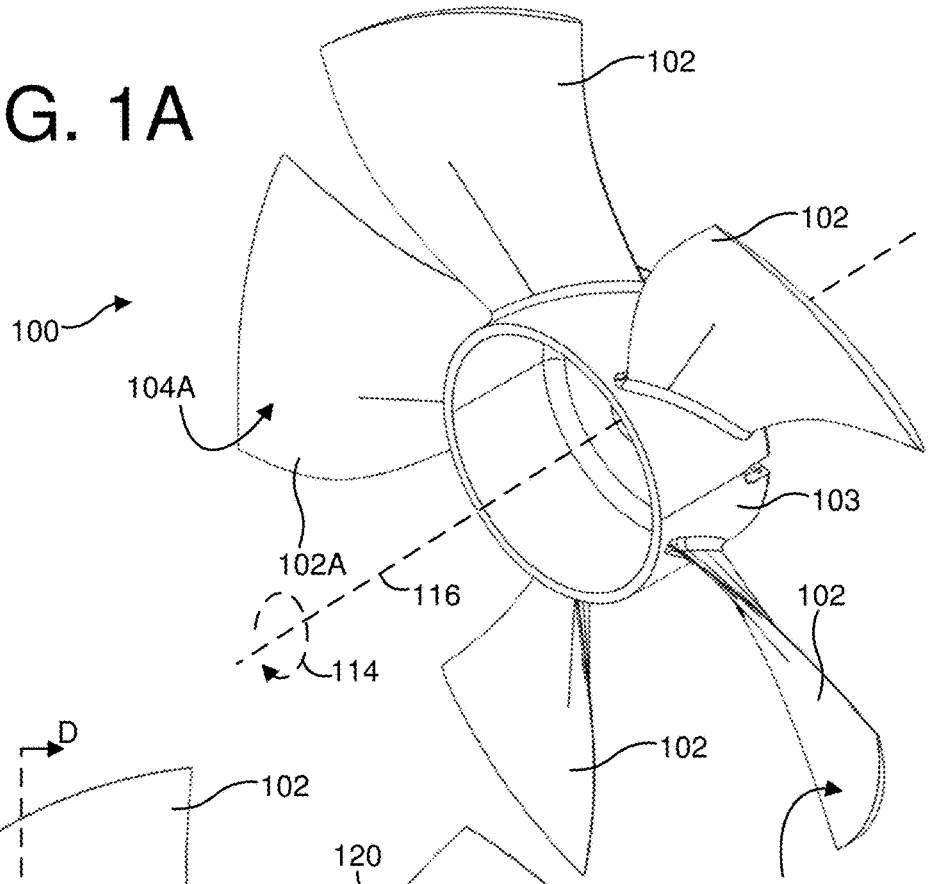
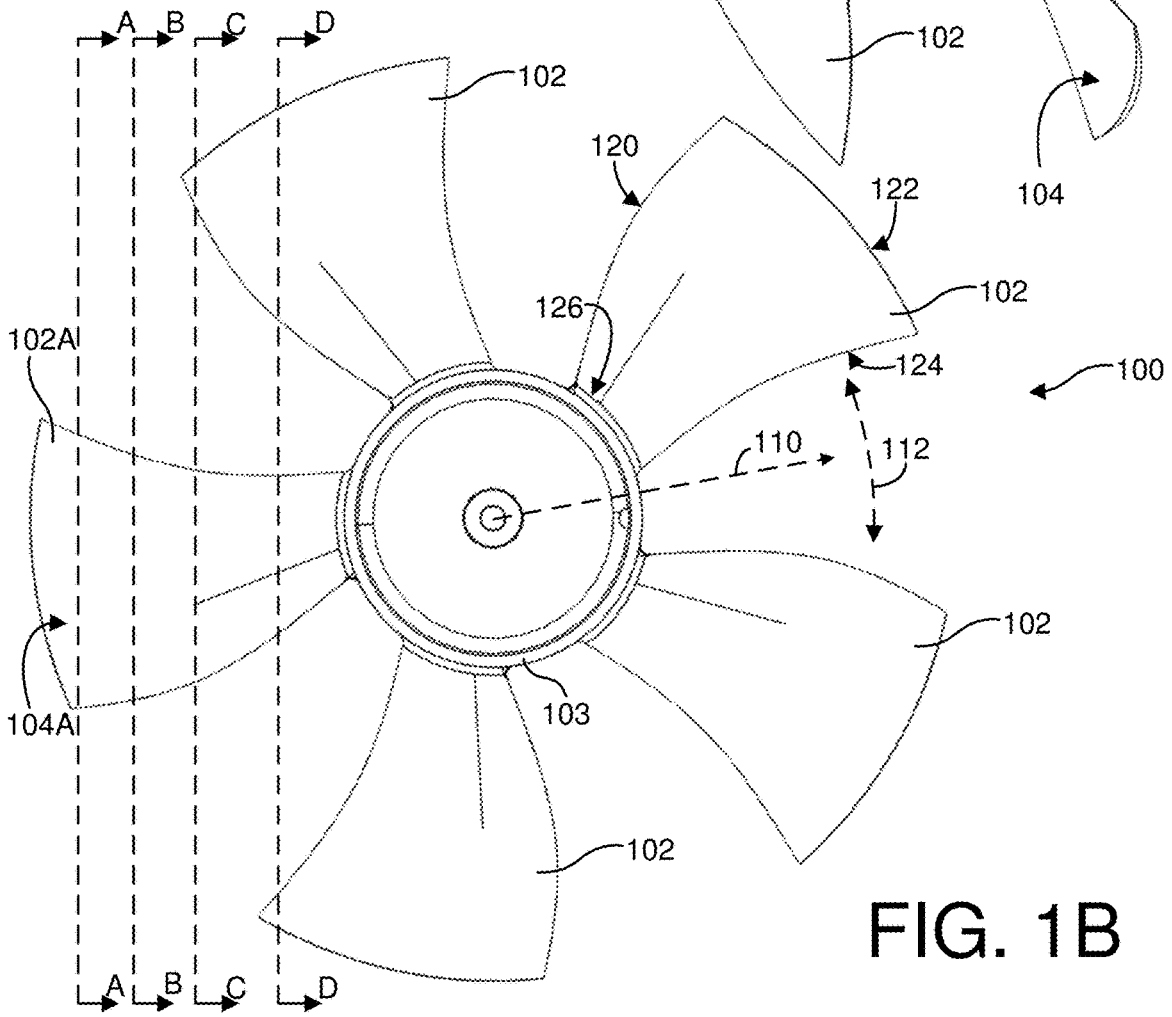
FIG. 1B

A-A

B-B

C-C

D-D

HIGH-EFFICIENCY COOLING FAN IMPELLER

BACKGROUND AND SUMMARY

This invention pertains generally to cooling fans used in, e.g., HVAC and refrigeration applications. More specifically, the invention is directed to a fan impeller having airfoil blades with a surface on the pressure-side of the blade that has a negative Gaussian curvature over the majority of the surface. In some embodiments, the Gaussian curvature of the surface is zero at some points on the surface.

A fan impeller includes multiple airfoil blades projecting radially outward from a circular hub with each blade positioned at a different azimuthal position of the hub. In operation, each blade has a surface facing the direction of air flow; this is the pressure-side surface. At each point on the pressure-side surface, the surface has two principal curvatures (k1 and k1). The product of these curvatures ($k1 \times k2$) is the Gaussian curvature at that point. In an embodiment of the invention, the Gaussian curvature is less than or equal to zero over the majority of the pressure-side surface. In an embodiment, the Gaussian curvature is less than or equal to zero over the entirety of the pressure-side surface. In embodiments, the first principal curvature (k1) is greater than or equal to zero ($k1 \geq 0$) at most or all points on the surface and the second principal curvature (k2) is less than or equal to zero ($k2 \leq 0$) at most or all points on the surface. In an embodiment, the first and second principal curvatures are non-zero and opposite at all points on the surface (i.e., $k1>0$ while $k2<0$ OR $k1<0$ while $k2>0$). In an embodiment, the blades are twisted along and about the radial direction and the pressure-side surface is substantially a twisted saddle shape.

BRIEF DESCRIPTION OF THE DRAWINGS

These and other features, aspects, and advantages of the present invention will become better understood with reference to the following description, appended claims, and accompanying drawings where:

FIG. 1A is a rear perspective view illustrating an exemplary impeller according to an aspect of the invention.

FIG. 1B is a rear view illustrating an exemplary impeller according to an aspect of the invention, and denoting certain section lines indicating sectional views of the impeller.

DETAILED DESCRIPTION

Figure 1C:
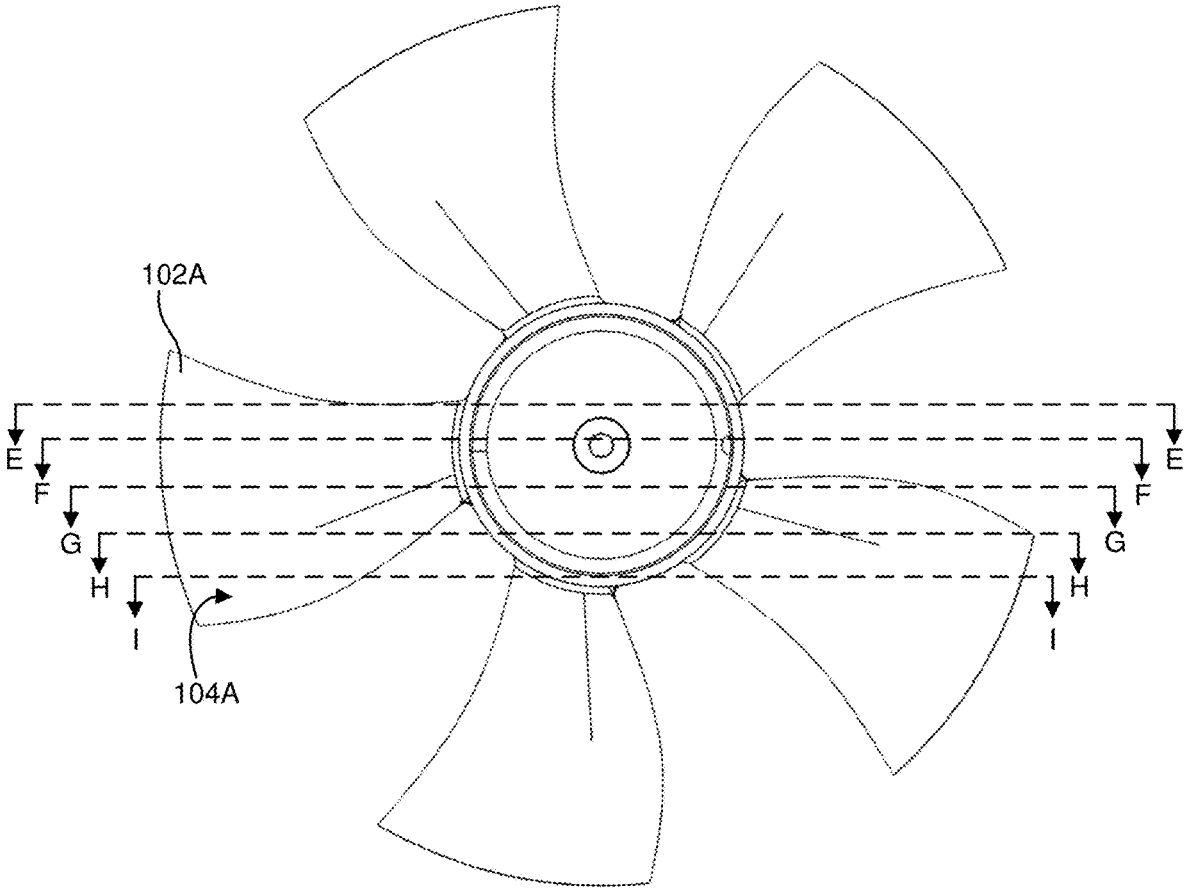
FIG. 1C is a rear view illustrating an exemplary impeller according to an aspect of the invention, and denoting certain section lines indicating sectional views of the impeller

In the summary above, and in the description below, reference is made to particular features of the invention in the context of exemplary embodiments of the invention. The features are described in the context of the exemplary embodiments to facilitate understanding. But the invention is not limited to the exemplary embodiments. And the features are not limited to the embodiments by which they are described. The invention provides a number of inventive features which can be combined in many ways, and the invention can be embodied in a wide variety of contexts. Unless expressly set forth as an essential feature of the invention, a feature of a particular embodiment should not be read into the claims unless expressly recited in a claim.

Except as explicitly defined otherwise, the words and phrases used herein, including terms used in the claims, carry the same meaning they carry to one of ordinary skill in the art as ordinarily used in the art.

Because one of ordinary skill in the art may best understand the structure of the invention by the function of various structural features of the invention, certain structural features may be explained or claimed with reference to the function of a feature. Unless used in the context of describing or claiming a particular inventive function (e.g., a process), reference to the function of a structural feature refers to the capability of the structural feature, not to an instance of use of the invention.

Except for claims that include language introducing a function with "means for" or "step for," the claims are not recited in so-called means-plus-function or step-plus-function format governed by 35 U.S.C. § 112 (f). Claims that include the "means for [function]" language but also recite the structure for performing the function are not means-plus-function claims governed by § 112 (f). Claims that include the "step for [function]" language but also recite an act for performing the function are not step-plus-function claims governed by § 112 (f).

Except as otherwise stated herein or as is otherwise clear from context, the inventive methods comprising or consisting of more than one step may be carried out without concern for the order of the steps.

The terms "comprising," "comprises," "including," "includes," "having," "haves," and their grammatical equivalents are used herein to mean that other components or steps are optionally present. For example, an article comprising A, B, and C includes an article having only A, B, and C as well as articles having A, B, C, and other components. And a method comprising the steps A, B, and C includes methods having only the steps A, B, and C as well as methods having the steps A, B, C, and other steps.

Terms of degree, such as "substantially," "about," and "roughly" are used herein to denote features that satisfy their technological purpose equivalently to a feature that is "exact." For example, a component A is "substantially" perpendicular to a second component B if A and B are at an angle such as to equivalently satisfy the technological purpose of A being perpendicular to B.

Except as otherwise stated herein, or as is otherwise clear from context, the term "or" is used herein in its inclusive sense. For example, "A or B" means "A or B, or both A and B."

An exemplary impeller 100 is depicted in FIGS. 1A-1C. FIG. 1A is a rear perspective view, and FIGS. 1B and 1C are each a rear view indicating various sections that are depicted in other figures. The exemplary impeller 100 includes five exemplary airfoil blades 102, 102A extending radially outward from a central hub 103, each blade at a different azimuthal position. (The radial direction is shown by the dashed straight arrow 110 in FIG. 1B and the azimuthal direction is shown by the dashed curved arrow 112 in FIG. 1B.) Each blade has a leading edge 124, a trailing edge 120, an inner edge 126 (where it connects to the hub 103), and an outer edge 122. The inner edge 126 is connected to the hub 103 such that it forms an angle to the axis of rotation (shown by the dashed line 116 in FIG. 1A) that differs from the angle formed by the outer edge 122 to the axis of rotation. In other words, the blades 102, 102A are twisted about and along the radial direction 110.

The rear surfaces 104, 104A of the blade 102, 102A are curved so as to form a substantially saddle-shaped surface that is twisted along the radial axis. The rear surface is the pressure-side surface when the impeller is in operation, rotating clockwise 114 about the rotational axis. That the surface is substantially saddle-shaped means that the surface has a negative Gaussian curvature over the majority of the surface area. Thus, the blade forms roughly the shape of a twisted, shallow, elongated saddle. In one embodiment, the pressure-side surface has either zero Gaussian curvature or negative Gaussian curvature. In a preferred embodiment, the two principal curvatures of the pressure-side surface are opposite (i.e., one being negative and the other positive) at all points on the surface, thus forming neither a convex nor concave surface at any point (all points on the surface are hyperbolic).

Figure 2:
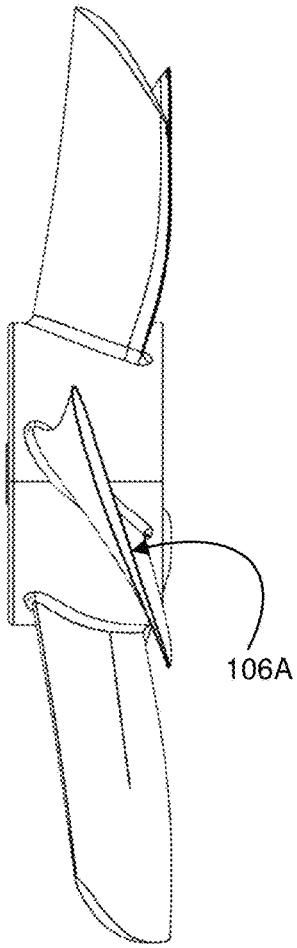
FIG. 2 is a side sectional view illustrating the curvature of an impeller blade's pressure-side surface at section A-A of FIG. 1B.
Figure 3:
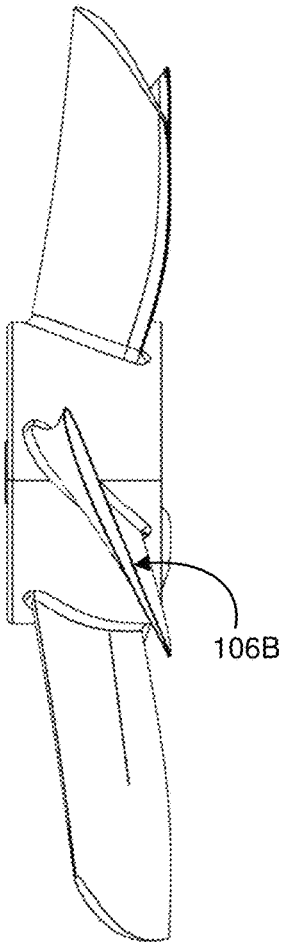
FIG. 3 is a side sectional view illustrating the curvature of an impeller blade's pressure-side surface at section B-B of FIG. 1B.
Figure 4:
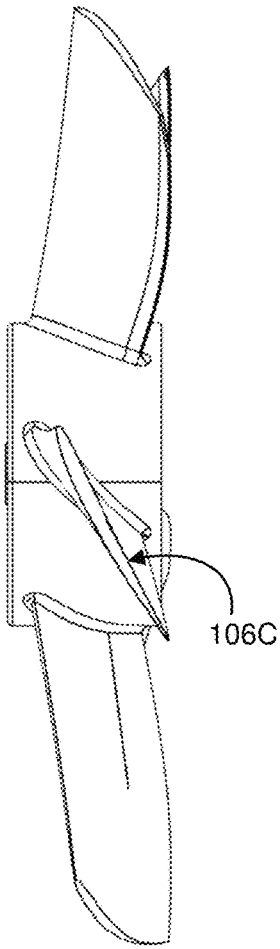
FIG. 4 is a side sectional view illustrating the curvature of an impeller blade's pressure-side surface at section C-C of FIG. 1B.
Figure 5:
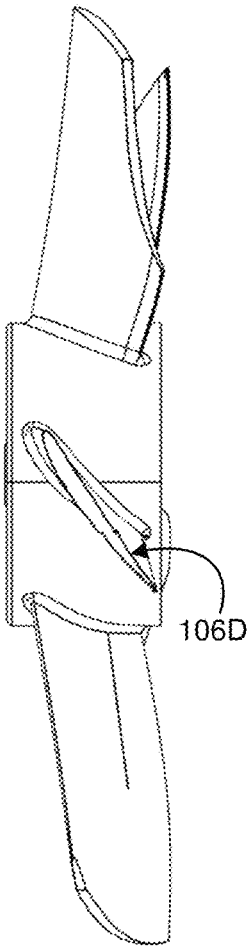
FIG. 5 is a side sectional view illustrating the curvature of an impeller blade's pressure-side surface at section D-D of FIG. 1B
Figure 6:
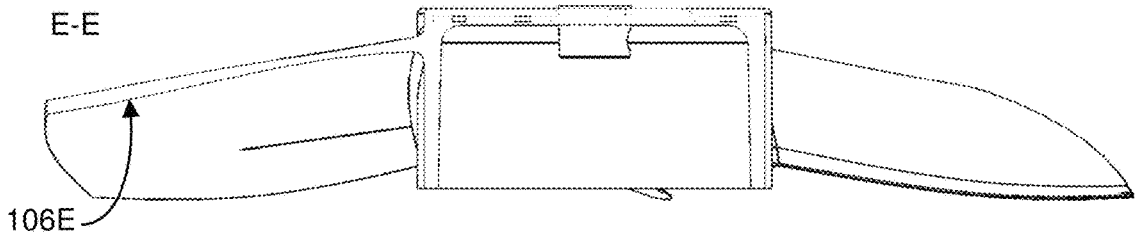
FIG. 6 is a side sectional view illustrating the curvature of an impeller blade's pressure-side surface at section E-E of FIG. 1C.
Figure 7:
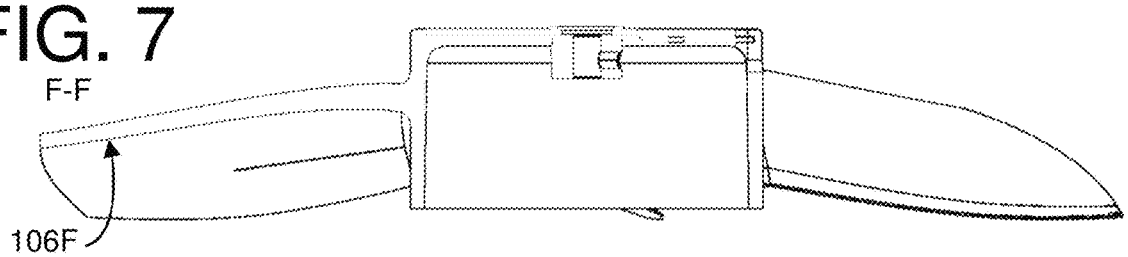
FIG. 7 is a side sectional view illustrating the curvature of an impeller blade's pressure-side surface at section F-F of FIG. 1C.
Figure 8:
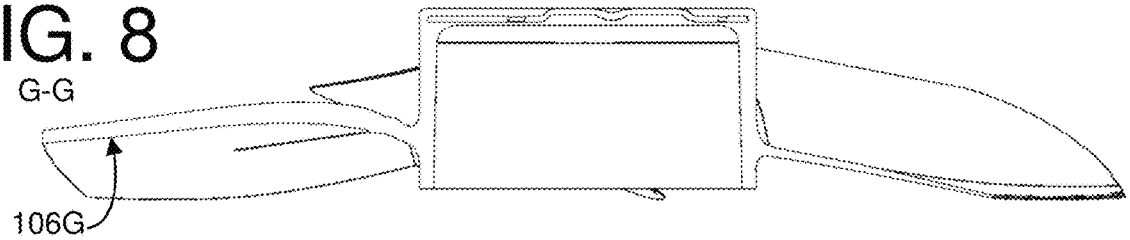
FIG. 8 is a side sectional view illustrating the curvature of an impeller blade's pressure-side surface at section G-G of FIG. 1C.
Figure 9:
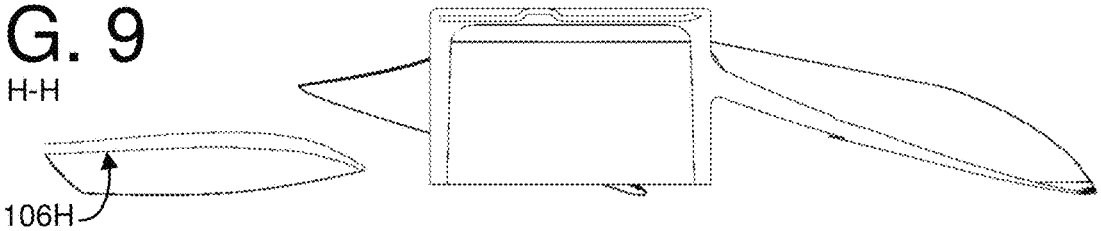
FIG. 9 is a side sectional view illustrating the curvature of an impeller blade's pressure-side surface at section H-H of FIG. 1C.
Figure 10:
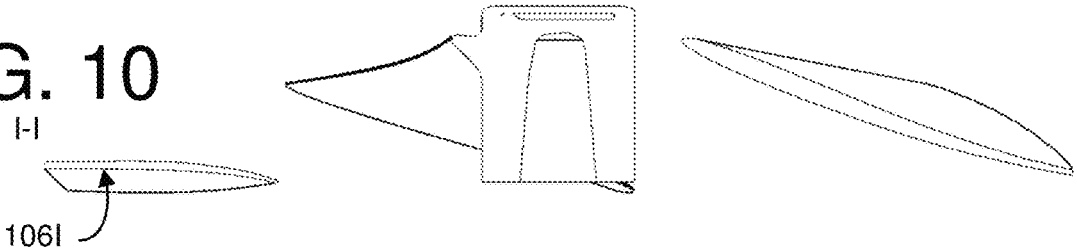
FIG. 10 is a side sectional view illustrating the curvature of an impeller blade's pressure-side surface at section I-I of FIG. 1C.

FIGS. 2-5 are side sectional views illustrating the curvature of the surface of the exemplary left-most blade 102A depicted in FIG. 1B at various distances from the axis of rotation of the impeller 100: FIG. 2 illustrates the curvature of the surface 106A at section A-A; FIG. 3 illustrates the curvature of the surface 106B at section B-B; FIG. 4 illustrates the curvature of the surface 106C at section C-C; FIG. 5 illustrates the curvature of the surface 106D at section D-D. FIGS. 6-10 are side sectional views illustrating the curvature of the left-most blade 102A depicted in FIG. 1B at various distances from the transverse-axis of impeller 100: FIG. 6 illustrates the curvature of the surface 106E at section E-E;

FIG. 7 illustrates the curvature of the surface 106F at section F-F; FIG. 8 illustrates the curvature of the surface 106G at section G-G; FIG. 9 illustrates the curvature of the surface 106H at section H-H; FIG. 10 illustrates the curvature of the surface 1061 at section I-I.

While the foregoing description is directed to the preferred embodiments of the invention, other and further embodiments of the invention will be apparent to those skilled in the art and may be made without departing from the basic scope of the invention. And features described with reference to one embodiment may be combined with other embodiments, even if not explicitly stated above, without departing from the scope of the invention. The scope of the invention is defined by the claims which follow.

The invention claimed is:

1. An impeller comprising:

(a) a circular hub having a central axis of rotation and a circumference, wherein the circumference defines an azimuthal direction about the axis of rotation; and (b) a plurality of impeller blades, each blade having a pressure-side surface with a surface area;

(c) wherein the blades are azimuthally distributed about the circumference of the hub;

(d) wherein each blade extends from the hub radially from the axis of rotation;

(e) wherein the pressure-side surface has a first principal curvature and a second principal curvature;

(f) wherein the first principal curvature is greater than or equal to zero over the majority of the surface area;

(g) wherein the second curvature is less than or equal to zero over the majority of the surface area;

(h) wherein the surface area for which the product of the first principal curvature and the second principal curvature is negative is greater than the surface area for which the product of the first principal curvature and the second principal curvature is positive; and (i) wherein the surface area for which the product of the first principal curvature and the second principal curvature is negative is greater than the surface area for which the product of the first principal curvature and the second principal curvature is zero.

2. The impeller of claim 1 wherein each blade is twisted about and along its radial extension from the hub.

3. The impeller of claim 1 wherein each blade has a curved leading edge and a curved trailing edge.

4. The impeller of claim 1 wherein the first curvature is greater than or equal to zero over the entirety of the surface.

5. The impeller of claim 1 wherein the second curvature is less than or equal to zero over the entirety of the surface.

6. The impeller of claim 1 wherein the first curvature is greater than zero over the majority of the surface.

7. The impeller of claim 1 wherein the second curvature is less than zero over the majority of the surface.

8. The impeller of claim 1 wherein the first curvature is greater than zero over the entirety of the surface.

9. The impeller of claim 1 wherein the second curvature is less than zero over the entirety of the surface.

* * * * *